United States Patent [19]

Behel

[11] 4,219,896

[45] Sep. 2, 1980

[54] COT STRUCTURE

[76] Inventor: O'Neal Behel, 103 Chickamauga St., Sheffield, Ala. 35660

[21] Appl. No.: 36,668

[22] Filed: May 7, 1979

[51] Int. Cl.[3] ..... A47F 1/00

[52] U.S. Cl. ..... 5/114; 5/110

[58] Field of Search ..... 5/110, 111, 114; 297/441

[56] References Cited

U.S. PATENT DOCUMENTS

| | | | |
|---|---|---|---|
| 1,982,165 | 11/1934 | Hounsfield | 5/114 |
| 2,675,564 | 4/1954 | Hughes | 5/82 |
| 3,134,987 | 6/1964 | Bertram | 5/114 |
| 3,956,781 | 5/1976 | Reemelin | 5/114 |

*Primary Examiner*—Casmir A. Nunberg

*Attorney, Agent, or Firm*—T. Eugene Burts

[57] ABSTRACT

The apparatus disclosed includes essentially a cot structure comprising, in combination, a folding frame having a flexible cover yieldable to body contour, and legs supporting said frame in displaced relation to a floor surface; said legs having a spring cantilever configuration and torsion residing in a single continuous bar member with opposite ends adapted to be received and held by said frame member; sockets so disposed in said frame member adapted to slidably receive the opposite ends of said leg bar members such that downward force on said legs secures the same in said sockets in rigid mode relative to said frame; hinges longitudinally disposed along the siderails of said cot structure as part of the same frame, said hinges each having a downwardly disposed pivot with upwardly disposed engaging interfaces, said interfaces engaging in occlusive buttress contact to distribute downwardly applied weight in a resolution of coherent force moments in optimum relation about said pivotal juncture for occupant support. Such structure achieves a buttress support platform integrated within the hinge as a joint knee to perfectly distribute the load to make the joint stronger with increasing weight.

2 Claims, 7 Drawing Figures

COT STRUCTURE

BACKGROUND OF THE INVENTION

1. Field of the Invention

This invention relates in general to support devices for sleeping, and more particularly to such portable sleeping devices as cots or moveable beds designed to be assembled and disassembled quickly and made portable to be carried by humans over long distances under severe environmental conditions, such as hiking or backpacking, but is equally adaptable as a light cot structure to be used around the home, taking up little space and more easily stored than the usual type structure heretofore furnished. It has long been a problem in this field to achieve the desired results of a light bed unit which can be easily carried, but which is also sufficiently strong to firmly support the human body in a semirigid condition on uneven terrain. One of the principle difficulties lay in the arrangement of a sufficiently flexible hinge for folding purposes which would also have sufficient rigidity and strength when unfolded to allow a large weight support. The present invention employs scientific structural principles of the resolution of forces to accomplish this end.

2. Discussion of Prior Art

It is generally assumed that this invention would lie within the U.S. Patent Trademark Office, Classification 5/111 and 5/114. Our field of search has included Class 5/111, 5/112, 5/114, and 5/117. The prior art in this field is illustrated by the early U.S. Pat. No. 1,982,165 to Hounsfield. Discloses a bedstead which could be used as a cot. The inventor in this patent states that the side-rails or rods may be hinged, jointed or divided wherever convenient in order to enable the bedstead to be folded into a small compass. However, there is no disclosure of the hinged type of joint distributing the weight in a buttress formation as indicated in the present invention; nor is there a use of the supporting leg bars in sockets in the manner embodied in the present invention. Angle members are used to support the leg bars which are of a cantilever design, but no advantage is taken of the spring effect of these bars by means of a taper at the bottom of the bore of the supporting T-pieces 7. The inventor uses little imagination and refers merely to a "sliding fit." There is really no suitable structure shown for a folding cot to be packed in a small space.

The early U.S. Pat. No. 1,944,064 to Byer discloses a folding cot which also has a cantilever leg support system in connection with a supporting sheet. This cot folds into a small bundle, but the structure in order to be firm is made of wide bars 3 which are supported in sockets in a rigid relation by means of notches in the ends of the bars supporting the undersurfaces of pins when such bars are in place. No hinge joint of the type shown in this invention is disclosed by Byer.

The early U.S. Pat. No. 2,156,507 to T. I. Means discloses a bed which appears to be essentially a trampoline type of structure not intended to be folded or used in the same manner as the previously discussed inventions.

The U.S. Pat. No. 2,641,777 to Karasek does not disclose in any way the same type structure which we have in the present invention, devoting this patent to a stirrup type of hinge joint which does not embody the same type of disposed force moments as we have in the present invention.

The U.S. Pat. No. 2,911,245 to Kurz discloses a joint for a collapsible cot or bed which comprises a complicated pawl and ratchet mechanism which does not bear any relation to the box type of buttress mechanism which we have in the present invention.

The U.S. Pat. No. 3,006,000 to De Groot discloses a camp stretcher having cantilever legs. This invention embodies steel cables to afford rigidity to the structure and uses a rather normal type of pivoting hinge member rather than the instant invention.

The U.S. Pat. No. 3,134,987 to Bertram discloses a cot structure wherein there appears to be a centilever type of leg support 34, but which is actually used only for the purpose of tension at the ends of the support sheet on the cot. The principle means of support is indicated in FIG. 6 and FIG. 7 by the hinges shown therein which do not embody the same principle as the hinges in the instant invention.

The U.S. Pat. No. 3,965,502 to Bertram discloses a later embodiment of his cot structure where in he does not employ hinges for the side rail structure, but uses a structure which telescopes mating ends of the side rails. The hinges which he uses are again of the stirrup type, fixedly riveted along the horizontal plane such that the vertical leg can pivot within the stirrup and be folded under the center support bar. This does not embody the same type of hinge structure or the same type of cantilever fixing structure for the supporting legs as is shown in the present invention.

The U.S. Pat. No. 3,999,229 issued to André Wyss of Switzerland discloses a double joint assembly to possibly be used in connection with a folding cot structure. This embodies a forked member, a clamping member and a bolt member which results in a triple linkage which is not similar at all in operation or effect to the structure shown in the present invention.

Thus, it can be seen that none of the patents in the prior art directly attack the problem of distributing the force of downward weight through a single hinge joint having multiple occlusive faces to achieve a single integral joint structure with a buttress effect. The previous patents, because of their complicated structure, or their complicated means of attaching the leg support members add such additional weight to such cot structures that they cannot achieve the light efficient type of cot which has been provided in the presently disclosed invention.

SUMMARY AND OBJECTS OF INVENTION

Accordingly, it is a primary object of this invention to provide in a cot structure one which is easily adaptable to use in backpacking and hiking conditions, wherein the structure may be easily assembled and dissembled but provide sufficient strength to properly support the body weight off of the ground under extreme environmental conditions.

In connection therewith, it is a further object of the invention to provide in such a cot structure one having the most simple folding frame with the most easily connected and disconnected supporting leg members, but affording a very strong structure in both the vertical and transverse modes. Accordingly, it is a salient feature of the present invention to embody in the cot structure the minimum amount of metal framework, relying principally upon the leg support members and the folding hinge members to afford strength to the structure.

It is, therefore, a further important feature of the invention to employ the simple spring cantilever configuration and torsion residing in a single continuous bar support member with the opposite end maintained in a fixed relation by means of a special socket adapted to more fixedly position the leg as the downward body weight is increased. This calls for a simple but special design of the sockets receiving the ends of such legs.

More importantly, it is a salient feature of the invention to employ a series of longitudinally disposed hinges along the side bars of the frame, with such hinges having downwardly disposed pivots with upwardly disposed engaging interfaces in buttress contact to widely distribute the downwardly applied weight in a resolution of coherent force moments about said pivot for occupant support.

DESCRIPTION OF PREFERRED EMBODIMENT

Figure 1:
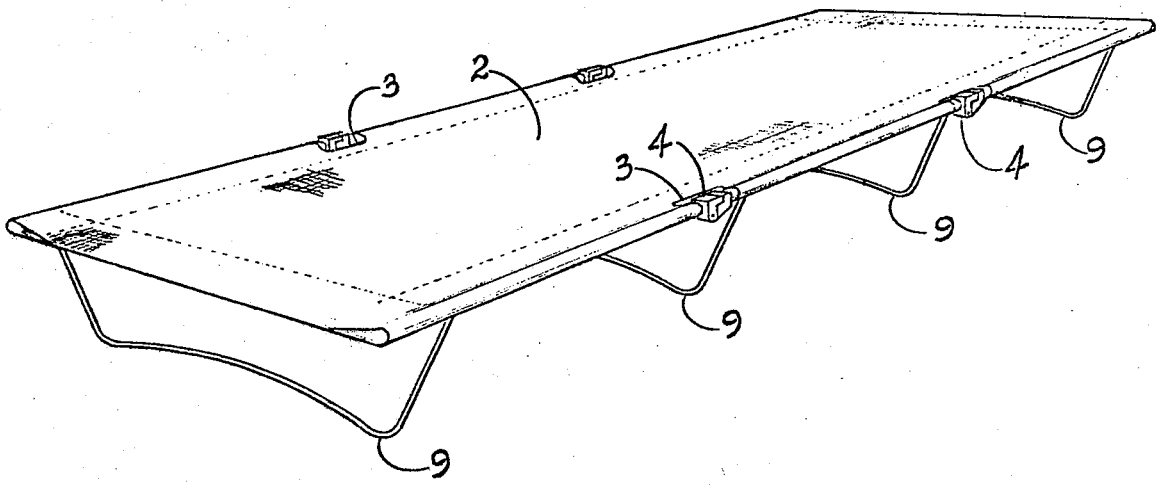
FIG. 1 is a side or elevation view of the cot structure of the invention in perspective.

Referring more particularly to the drawings, it will be seen that the apparatus of the invention comprises essentially a pair of side rails 1 which support or suspend a body support sheet 2 which is made of appropriate material for the conditions under which the cot structure is to be used. In this particular embodiment it can be made of very strong woven nylon material sewn in such manner as to provide running lengthwise of each side a flap having a large loop to accomodate the size of the hinges which will be mentioned hereafter.

The body support sheet 2 is provided with a series of openings 3 along the sides to accomodate the hinges which are generally referred to as 4 indicated in the drawings. Due to the nature of the size of these hinges the loop along the sides of the support sheet must be sufficiently wide to allow the same to be opened with the hinges passing therethrough to remove the support sheet from the frame for cleaning purposes.

It is also necessary that there be openings 5 along the length of the side rails 1 corresponding with openings in the body support sheet to receive the ends of the leg supports 9 within the metal sleeves 6 having a regular bore 7 at the end of which there is a tapered tap 8. The distal end of the sleeve 6 is provided with a protruding brad or suitable portion 11 which may protrude through an opening in the side rail and be flattened or which may comprise a weld which fixes the sleeve within the core 10 of the side rail flush with the opening 5 at its bottom side. The foregoing can best be seen from FIG. 6 which is a partial section of the leg members 9 shown as journaled within the sleeves 6 before being pushed into the tap which is tapered at the bottom of the sleeve as indicated.

Figure 2:
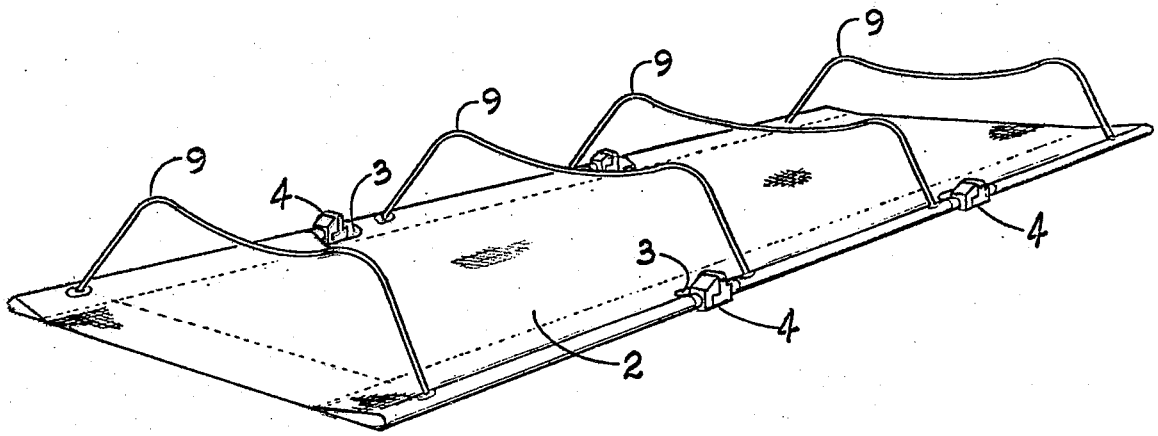
FIG. 2 is the same cot structure as shown in FIG. 1 from the underside as it would be viewed by the observer, to reveal the position of the hinge members and leg support members with the cot assembled.

As indicated in FIG. 1 and FIG. 2, when the cot structure is assembled the leg support members 9 are fitted through corresponding openings in the body support sheet 2 in order that they may be received by the sleeves 6 in the side rails 1. The body support sheet is thus maintained in a tensioned position laterally by means of the cantilever action of the supporting legs 9, which are pretensioned when they are forced into the sleeves, aforesaid.

Figure 3:
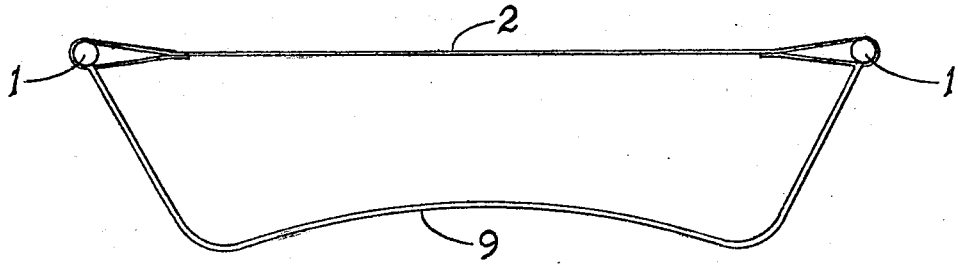
FIG. 3 is a partial cross section taken through any portion of the side rails of the cot structure between the leg supports, to show the cross section of the hollow side rail supporting the body support sheet with the leg support members in their relative position.
Figure 6:
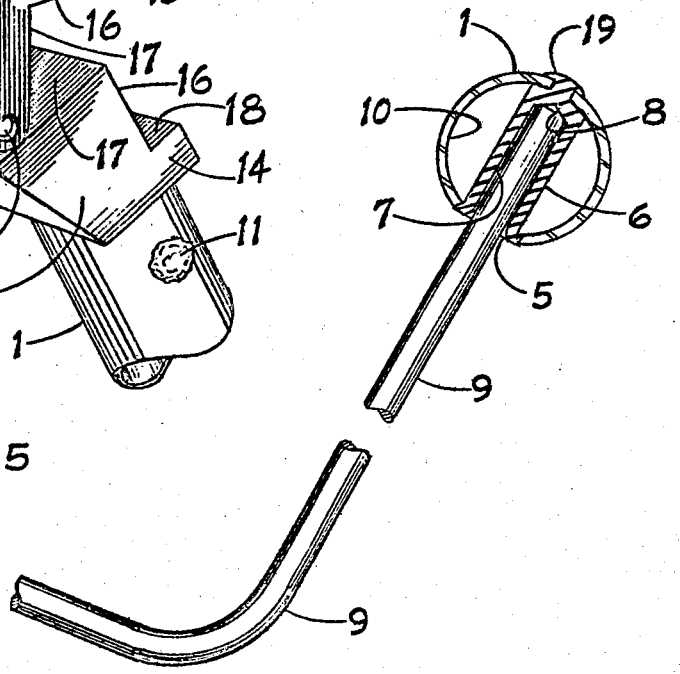
FIG. 6 is a partial broken section taken at any point along the side support rails of the cot structure through the point of the center of one of the sockets showing the sleeve which supports the end of the leg members with its bore in proper relation and the means of attaching the same.

From FIG. 3, it can be seen that if a body weight is placed downwardly in the middle of the body supporting sheet 2, further tension is going to be activated in the ends of the supporting legs 9 which will be pushed further into the sleeves 6 and into the tapered tap of the sleeve at the bottom thereof as indicated in FIG. 6.

From FIG. 2 it can readily be seen that with the underside view of the cot structure the leg support members bear a definite relationship to the downwardly projecting hinges along the side rails 1. By positioning the sleeve apertures such that the longitudinal axis thereof is slightly turned inward, and the depending portion of the hinges 4 are slightly canted the cot does not have a tendency to fold up along its pivotal hinges when it is picked up by its support legs from the bottom.

Figure 4:
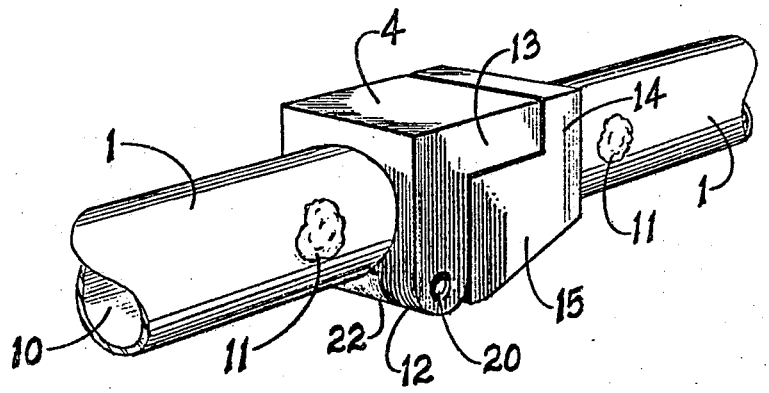
FIG. 4 is a perspective view of the hinge support member together with a partial broken section of the side rails, with such hinge support member in the locked position when supporting on the upper surface the weight of a body on the support sheet.
Figure 5:
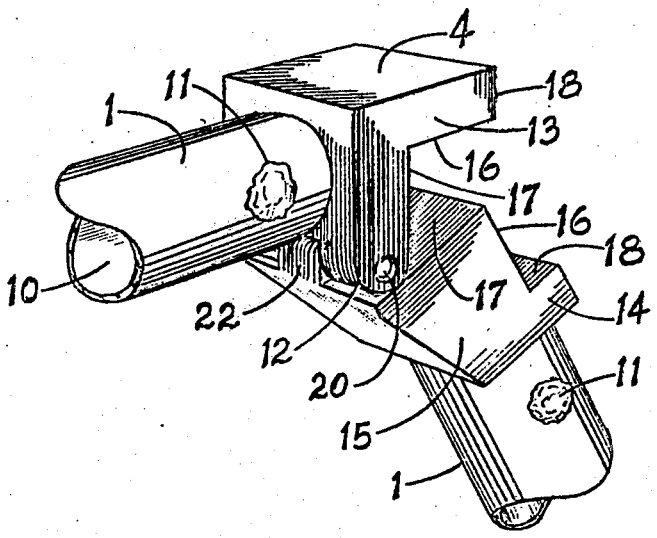
FIG. 5 is the same hinge member as shown in FIG. 4, in perspective in the open position as it would appear when folding the cot structure.

Referring more particularly to FIGS. 4 and 5, it should be remembered that the force of the body weight on the support sheet is such that the downward bearing weight is not in a truly vertical direction, but slightly canted toward the center of the cot. Therefore, the slight canting of the depending portions of the hinge members relative to the sockets for the leg members properly coordinates to bring in line the forces of stress in the proper direction for all of the same to be absorbed by the hinges.

Both of the occlusive, weight supporting faces of the hinge 4 are of an L-shaped box type configuration providing legs 12 and 13 of the upper hinge plate and legs 14 and 15 of the lower hinge plate relative to the L-shaped structure.

Because of the obvious stresses set up in this hinge as a supporting member, the lower leg 15 which depends from the vertical leg 14 of the lower hinge plate is slightly thickened or widened as it approaches the pivot point. This affords a point of greatest strength where the greatest weight is being borne on the hinge member.

Examining FIG. 5, with the hinge member 4 in the open or broken position for folding, one can see that the hinge is pivotally connected by means of tongue 22 seated in a groove with the hinge maintained in position by pin 20.

It should be noted at this point, in FIGS. 4 and 5, welds 11 fix the hinge shanks in the cores 10 of rails 1 on each side. As shown in FIG. 6, sleeves 6, to receive legs 9, are spaced along rails 1, maintained in apertures 5 with flared open proximal ends flush therewith. The end of each sleeve 6 is maintained in rail 1 by means of a piercing weld or brad 19 at the distal end.

It should be noted from FIG. 5 with the hinge in the opened position that there are provided for each hinge plate three occlusive weight bearing faces 16, 17 and 18 as shown. With the hinge closed, in the weight bearing mode, as indicated in FIG. 4, it can readily be seen that the occlusive faces 16, 17 and 18 widely distribute the weight bearing points over the entire area of these occlusive faces, with the moments of force in a generally horizontal direction on the face 18, a generally vertical direction on the face 16 and a generally horizontal direction again on the face 17. Thus, the force moments are resolved to their optimum point of efficiency over this large bearing surface in two opposing horizontal vectors and one opposing vertical vector. It will be apparent from an analysis of this situation that the maximum amount of the force is resolved away from the vertical direction in an increment weight bearing vector more available in a horizontal direction more widely dispersed than in any other type of hinge arrangement heretofore disclosed in the prior art.

Figure 7:
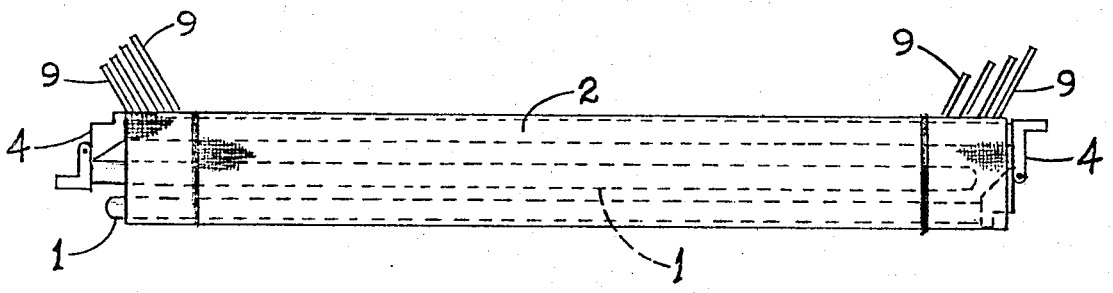
FIG. 7 is a partial diagramatic rendition of the folded cot as it would appear from a side view with the leg bar members tucked inside of the top opening of the fold and binding bands holding the entire structure together for storage.

Referring more particularly to FIG. 7, it can readily be seen that to provide proper folding of the three side rail pieces, one over the other, the hinges in alternate positions would be modified to provide in one pair of hinges on the corresponding side longer hinge leg 11 and hinge base legs 15 in thickness to allow the folded leg to be suspended at a distance slightly above the folded position occupied by the other leg at the opposite end of the side rail. This does not change the integrity of the structure of the hinge member and they can be so arranged, by selection, that the thicker hinge is under that portion of the cot which supports the hips.

Now it will be seen that the invention is one well adapted to achieve the ends and objects set forth in the beginning of the specification. This cot is one which may be very quickly disassembled or assembled. By using the cantilever spring bar circular type of leg, in combination with a relatively loose fitting sleeve in the side rail it is easy to quickly insert the ends of the tension legs into these sleeves, where the legs will move from side to side until a weight bearing force is exerted from above on the side rails. When this weight bearing force occurs the ends of the leg members 9 are jammed into the tapered tap portion of the sleeves 8 in such manner that the legs now become fixed in rigid position within the sleeves and the cot does not wobble or move in any direction with the weight bearing force in the downward direction. When the force is relieved the leg may be quickly pulled from the sleeve and laid aside to be folded into the disassembled cot. When disassembling the cot, the legs are first removed from the sockets in the side rails and laid aside with the cot positioned with its back side up as shown in FIG. 2, then the side rails are folded toward the middle of the structure with the support sheet still in the stretched position. A difference in the corresponding legs of the hinges allows this, together with an allowance for a different length of the corresponding siderails as may be appropriate. As soon as the entire cot structure has been folded in along the center pair of side rails, one may then start from each outer edge at a side rail and make one fold toward the center of the support sheet, folding on alternate sides until one gets to the center where such a folding provides an envelope into which may be inserted the aligned leg support members 9 as shown in FIG. 7.

The reverse practice is used in assembling the cot. One removes the binding straps or other support means used to hold the cot structure and the legs in the envelope. In the commercial embodiment of the invention the entire cot is provided with a cover which holds the assembly together. One then unfolds the rolled side rails from the center toward the side until the sheet is fully laterally disposed. The next movement is to fold each end outwardly with the cot in the down side up position as shown in FIG. 2. The last movement involves simply slightly turning the depending hinge sections and side rails canted inwardly and inserting each of the ends of the leg members 9 into the sleeves 6 along the underside of the side rails as indicated. The cot is now assembled and ready to be turned over into the position shown in FIGS. 1 and 3. The actual assembly time for the cot is approximately the same as that required to describe these movements. The same is true of disassembly.

Therefore, it can be seen that we have provided a cot structure of simple design which is easily adaptable for backpacking and hiking of the type generally conceived. The cot can be made of a very light aluminum material for its side rails or such other suitable material to provide the minimum amount of weight with the maximum amount of strength. The cover is provided of nylon material which may be specially treated to provide a waterproof covering. The very comfortable suspension of body by this means of support is well known. Since there are no transverse support members other than the leg supports which are of cantilever design there is a "give" to the supporting sheet which approaches that of a mattress. The leg supports are sufficient to maintain the body above ground level. If it is desired the leg supports can be made in several sections with telescoping fitted joints attached in the unassembled position by chains to avoid losing the same. In this manner the legs can be stored in a much smaller space. The envelope of the fold of the cot sides will very well accomodate this.

It can also be seen that we have provided a hinge supporting member which affords the most strength and best resolution of forces of any hinge member known to date.

From the foregoing it will be seen that the invention is well adapted to attain all of the ends and objects herein above set forth. Together with other advantages which are obvious and which are inherent to the structure. It will be understood that certain features of any sub-combinations of the invention are of utility and may be employed without reference to other features and sub-combinations. This is contemplated by and is within the scope of the claims.

As many possible embodiments of the invention may be made without departing from the scope thereof, it is to be understood that all matter set forth or shown in the drawings is to be interpreted as illustrative and not in a limiting sense.

Having thus described the invention, what is claimed is:

1. In a cot structure of the character described having parallel side rails and a weight bearing flexible body supporting sheet suspended therebetween, with removable leg support members in spaced relation lengthwise along said side rails, the combination comprising:

hinge members joining sequential lengths of said side rails;

said hinge members having a downwardly disposed pivotal joint connecting extended congruent angled laterally disposed face plates in weight bearing mode, such plates disposed in occlusive contact in said mode to provide maximal extensive and lateral dispersal of the force vectors per unit of bearing surface with multiplanar resolution of the force moments about their pivotal junctures;

said face plates further comprising an inverted L-shaped box configurated overplate and a semi-L-shaped box configurated underplate pivotally connected thereto, said underplate having a greater under support mass, and said overplate and underplate having their congruent occlusive faces during weight bearing mode on said side rails resolving the opposing force moments relative to their transverse pivotal juncture into at least two divergent force planes.

2. In a cot structure of the character described having parallel side rails and a weight bearing flexible body supporting sheet suspended therebetween, with removable leg support members in spaced relation lengthwise along said side rails, the combination comprising:

hinge members joining sequential lengths of said side rails;

said hinge members having a downwardly disposed pivotal joint connecting extended congruent angled laterally disposed face plates in weight bearing mode, such plates disposed in occlusive contact in said mode to provide maximal extensive and lateral dispersal of the force vectors per unit of bearing surface with multiplanar resolution of the force moments about their pivotal junctures;

said face plates further comprising an inverted L-shaped box configurated overplate and a semi-L-shaped box configurated underplate pivotally connected thereto, said underplate having a greater under support mass, and said overplate and underplate having their congruent occlusive faces during weight bearing mode resolving the opposing force moments relative to their transverse pivotal juncture, said occlusive faces lying in perpendicular angular planes in occlusive contact to resolve the force moment about the pivotal juncture of said hinge plates into at least two perpendicular force vectors.

* * * * *